US010288352B2

(12) United States Patent
Bugler

(10) Patent No.: US 10,288,352 B2
(45) Date of Patent: May 14, 2019

(54) THERMAL CAPACITY OF ELLIPTICALLY FINNED HEAT EXCHANGER

(71) Applicant: Evapco, Inc., Taneytown, MD (US)

(72) Inventor: Thomas W. Bugler, Middletown, MD (US)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 15/402,069

(22) Filed: Jan. 9, 2017

(65) Prior Publication Data

US 2017/0198973 A1 Jul. 13, 2017

Related U.S. Application Data

(60) Provisional application No. 62/276,328, filed on Jan. 8, 2016.

(51) Int. Cl.

| | |
|---|---|
| ***F28C 1/14*** | (2006.01) |
| ***F28D 5/02*** | (2006.01) |
| ***F28F 1/02*** | (2006.01) |
| ***F28F 1/36*** | (2006.01) |
| ***F28B 1/06*** | (2006.01) |
| ***F28D 1/047*** | (2006.01) |

(52) U.S. Cl.

CPC ..... *F28C 1/14* (2013.01); *F28B 1/06* (2013.01); *F28D 1/0477* (2013.01); *F28D 5/02* (2013.01); *F28F 1/02* (2013.01); *F28F 1/36* (2013.01)

(58) Field of Classification Search

CPC .. F28C 1/14; F28B 1/06; F28D 1/0477; F28D 1/0478; F28D 5/02; F28F 1/02; F28F 1/36

See application file for complete search history.

(56) References Cited

U.S. PATENT DOCUMENTS

| | | | | |
|---|---|---|---|---|
| 4,755,331 | A | 7/1988 | Merrill et al. | |
| 4,974,422 | A | 12/1990 | Kocher | |
| 2008/0142201 | A1 | 6/2008 | Derosier et al. | |
| 2011/0100593 | A1* | 5/2011 | Benz | F28B 1/06 165/59 |
| 2012/0012292 | A1 | 1/2012 | Bugler, III et al. | |
| 2012/0067546 | A1 | 3/2012 | Bugler et al. | |
| 2014/0138050 | A1 | 5/2014 | Byrne | |

OTHER PUBLICATIONS

Evapco. "Evapco eco-PMC Evaporative Condensers." Sep. 23, 2015. https://www.archive.org/web/*/http://www.evapco.com/products/ecopmc_evaporative_condenser.

International Search Report issued in co-pending International Application No. PCT/US17/12765 dated Apr. 28, 2017.

* cited by examiner

*Primary Examiner* — Travis C Ruby

(74) *Attorney, Agent, or Firm* — Whiteford, Taylor & Preston, LLP; Peter J. Davis

(57) ABSTRACT

Spiral finned elliptical tube closed circuit coolers and evaporative refrigerant condensers in which the air flow entering the unit is directed to flow across the tubes in a direction that is parallel to the tube axes and generally perpendicular to the fins produce a completely unexpected gain in capacity of 25% compared to comparable units in which the air flow is directed across/perpendicular to the tube axes.

11 Claims, 5 Drawing Sheets

THERMAL CAPACITY OF ELLIPTICALLY FINNED HEAT EXCHANGER

BACKGROUND OF THE INVENTION

Field of the Invention

The present invention relates to closed circuit coolers and evaporative refrigerant condensers.

Description of the Background

Both evaporative closed circuit coolers and evaporative refrigerant condensers utilize heat exchangers to transfer heat from an internal fluid or refrigerant indirectly to an external circulating fluid that is usually water. The circulating water, in turn, transfers heat and mass directly to the air. The air flow is induced or forced through the heat exchanger via a motive device such as a fan. The heat exchanger, in the established technology, consists of multiple serpentine tubes that are connected to the main fluid or refrigerant flow via header assemblies. The thermal capacity of these coolers and condensers is a function of the mass air flow rate as well as the internal and external heat transfer coefficients of the heat exchanger coil.

One previous technology advancement, over the original round bare tubes, improves the mass air flow rate by changing the round tube shape to elliptical, with the long axis of the ellipse parallel to the air flow direction (U.S. Pat. No. 4,755,331). Since the ellipse is more aerodynamically shaped than the round tube, the air flow resistance is reduced, air flow is subsequently increased, and, thereby, thermal capacity is increased.

Another previous technology improvement has changed the angles of the long axis of the ellipse in an alternating pattern, left and right. The thermal heat rejection capability of each tube increases with the canted pattern which also results in a larger spacing between tubes. This effectively reduces cost by reducing the number of tubes required to achieve the same heat rejection capability of the vertically positioned tube.

Another previous and significant technological advancement places spiral fins on the elliptical tubes of the heat exchanger at a specific spacing and fin height. This advancement increases the overall thermal capacity of the heat exchanger by a very significant amount. The fins are spaced along the length of the tubes so as to increase the thermal heat transfer coefficients without increasing the resistance to air flow. Since this technological advance also extends the total amount of heat transfer surface, it allows water conservation and visible plume reduction through partial or complete dry operation at reduced environmental air temperatures.

SUMMARY OF THE INVENTION

All of the coolers and condensers that use the spiral fins on elliptical tubes either pull or push the air into the plenum beneath the coil either from the side (perpendicular to the tube axis and parallel to the longitudinal axis of the fins) or from all sides. Although it seems counterintuitive, it has now been discovered that by orienting the air flow entering the heat plenum to be parallel to the tubes (perpendicular to the fin axis), an additional gain in thermal capacity is realized. Initial test results show that orienting the air flow so that it enters the plenum from a direction that is parallel to the tube axis and perpendicular to the fin axis produces a total gain in capacity of 25% compared to when the air inlet air flow is perpendicular to the tube axis and parallel to the fin axis.

This additional capacity gain due to the orientation of the coils relative to the inlet air direction was highly unexpected.

Arranging the fan, coils, and air inlet faces to cause the air flow to enter the plenum from a direction parallel to the tube axis/perpendicular to the fin axis can be done is several ways, depending on the fan type and unit type.

For example, the axial fan induced draft counterflow cooler or condenser, for a single cell unit, draws air into the plenum from all four sides. To produce the desired improvement result for this unit, the coils remain in the same orientation, with the heat exchanger tubes running parallel to the two long sides of the unit and perpendicular to two short sides of the unit. To get the inlet air flow mostly parallel to the tube axis, air inlets are provided only on the two air inlet faces that are the short side of the unit, the sides with the tube ends. In a unit that has already been constructed, the air inlets on the long sides (the sides that parallel the length of the heat exchanger tubes) are sealed off, leaving the air inlets open on the remaining two short sides. This arrangement causes all of the air entering the plenum of the unit to enter from a direction that is parallel to the heat exchanger tube axes and perpendicular to the longitudinal axis of the fins. In order to accommodate increased air flow through the sides that face the tube ends without increasing the pressure loss significantly, the height of the air inlet openings may be increased, increasing the air inlet cross sectional area and reducing the air inlet velocity to a desired level. A further advantage of this arrangement is that units may be positioned as multiple cells with the closed sides side-by-side without penalty. It is noted that the "long" and "short" side designations in the foregoing description are intended to designate the side of the unit that is parallel to the tube length ("long") and the side of the unit that faces the tube ends ("short"), respectively. In the case of a unit that is substantially square in plan, the invention is achieved by providing air inlets to the plenum on only the two sides of the unit that face the tube ends.

There are several additional possibilities for a forced draft unit with either axial or centrifugal fans all on one side. In a first embodiment, the coils are rotated 90 degrees so the heat exchanger tube axis is parallel to the direction of air flow entering the plenum. For another embodiment, the fans are placed on either one or both of the short ends. In a third embodiment, a two cell, back-to-back arrangement has coils that are rotated 90 degrees relative to a standard orientation, but these coils run fully across the width of both cells so that longer coils could be utilized.

DETAILED DESCRIPTION

Figure 3:
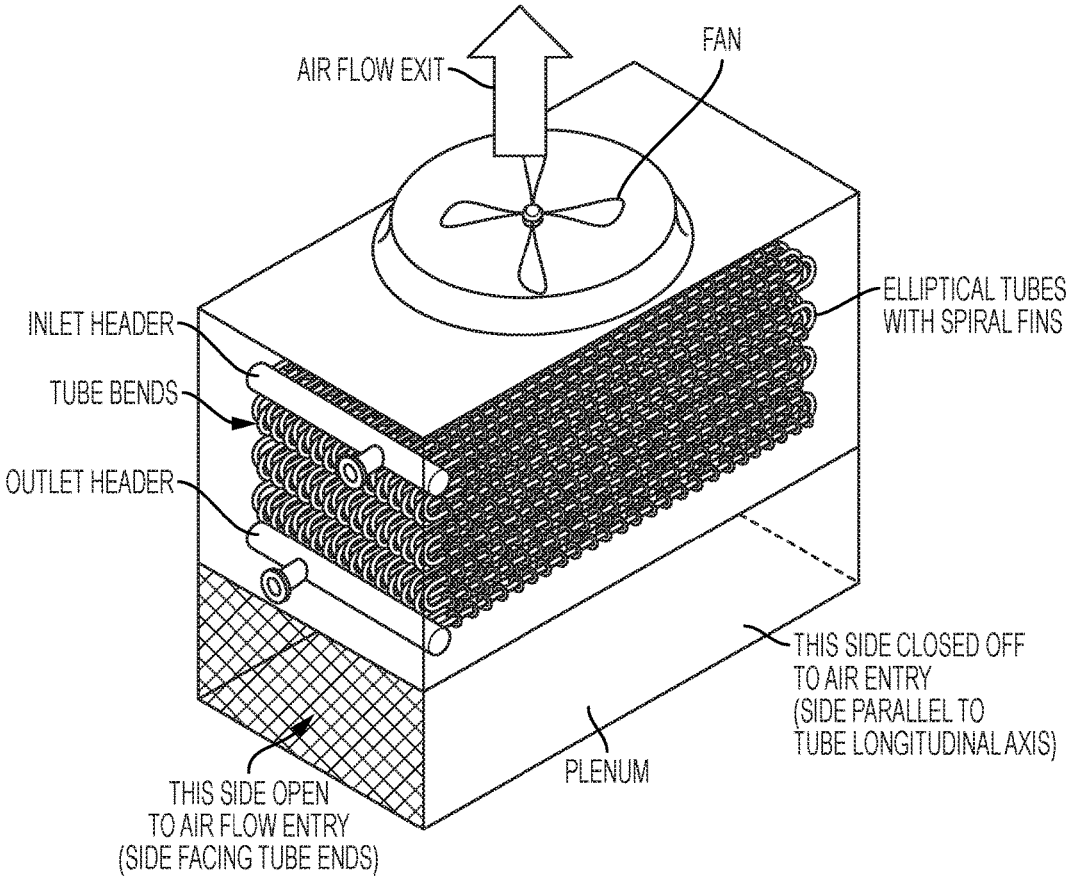
FIG. 3 is a cutaway view of an induced draft single cell unit according to an embodiment of the invention.

FIG. 3 shows an induced draft single cell evaporative cooler according to a first embodiment of the invention. At the top of the unit is the fan which draws air into the unit and forces it out the top of the unit. Below the fan (not shown) is a water distribution system that distributes water over the tube coil. The tube coil is made of an array of serpentine elliptical tubes with spiral fins. Each length of tube is connected at its ends to an adjacent higher and/or lower tube length by a tube bend. Process fluid to be cooled enters the tubes via an inlet header and exits the tubes via an outlet header. Beneath the tube coil is the plenum, where air enters the unit and the water that is delivered to the unit via the water distribution system is cooled via direct heat exchange with the air, collects at the bottom and recirculated to the top via water recirculation system, not shown. Whereas the prior art units, air inlets were provided on all four sides of the plenum allowing the fan to draw air into the plenum and into the tube coil from all four directions. According to the invention, however, no air inlets are provided on the sides of the plenum that parallel the longitudinal axis of the tube lengths, and air inlets are only provided on the sides of the plenum that are beneath the tube ends/tube bends. The inventors have unexpectedly discovered that by providing air inlets only at the ends of the plenum beneath the tube ends and not allowing air to enter the plenum from the sides that parallel the longitudinal axes of the tubes, the capacity of the unit may be surprisingly increased by 25%.

Figure 1:
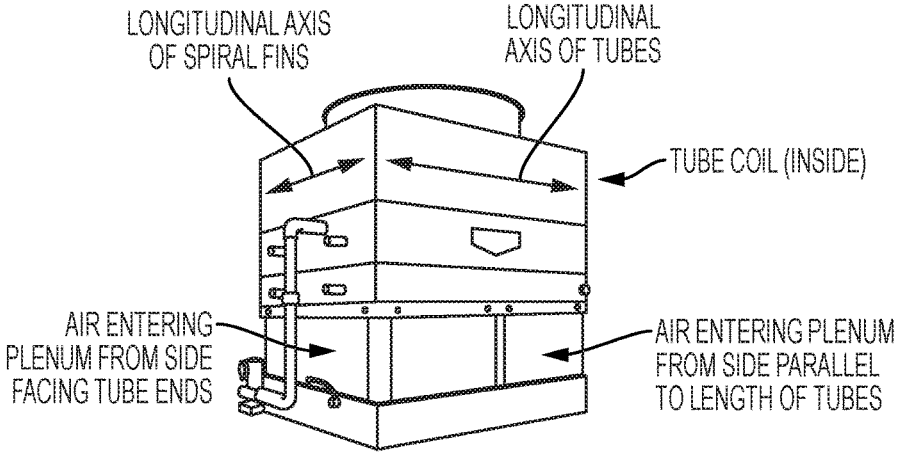
FIG. 1 PRIOR ART
FIG. 1 is a prior art induced draft single cell unit.
Figure 2:
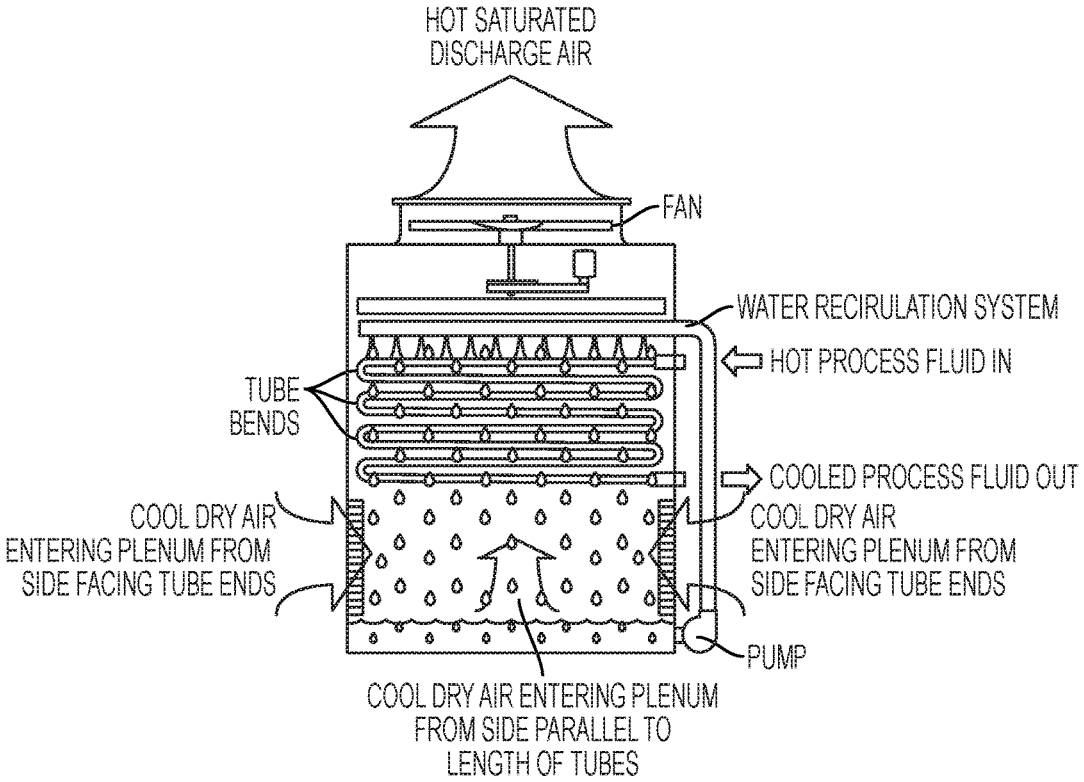
FIG. 2 PRIOR ART
FIG. 2 is a cutaway view of a prior art induced draft single cell unit.

According to an alternative embodiment, prior art induced draft devices (specifically, evaporative coolers with elliptical tube with spiral fins, see FIGS. 1 and 2) may be modified according to the invention by sealing off the air inlets on the sides of the unit that parallel the longitudinal axis of the tubes. Even by reducing the surface area of the air inlets by more than 50%, it was surprisingly discovered that modifying prior art devices as discussed that the capacity of the units increased by 25%.

Figure 4:
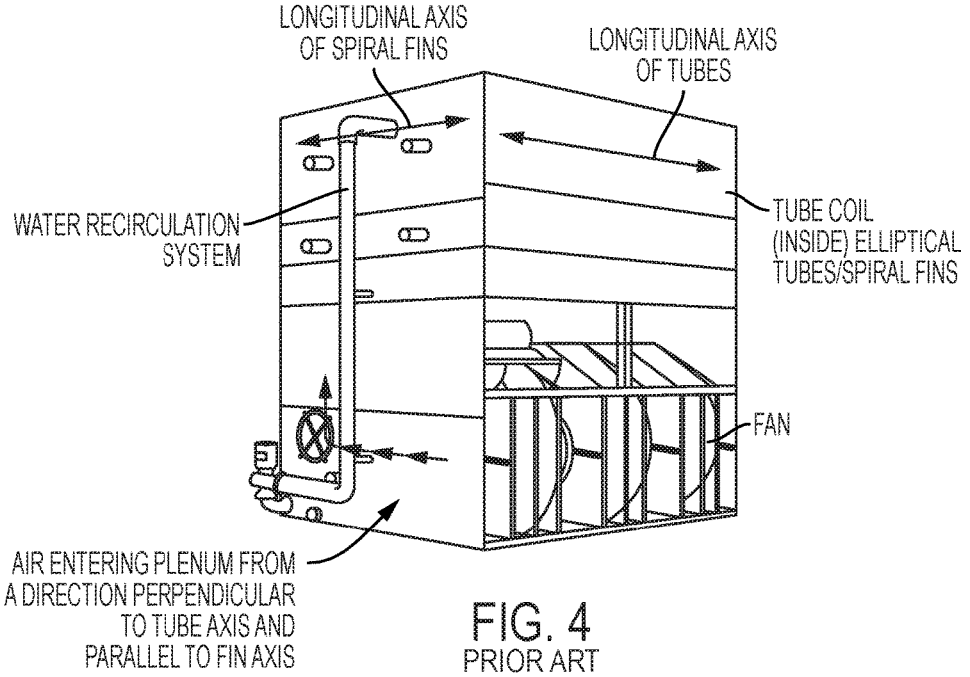
FIG. 4 PRIOR ART
FIG. 4 is a prior art induced forced draft single cell unit with axial fans on one side.
Figure 5:
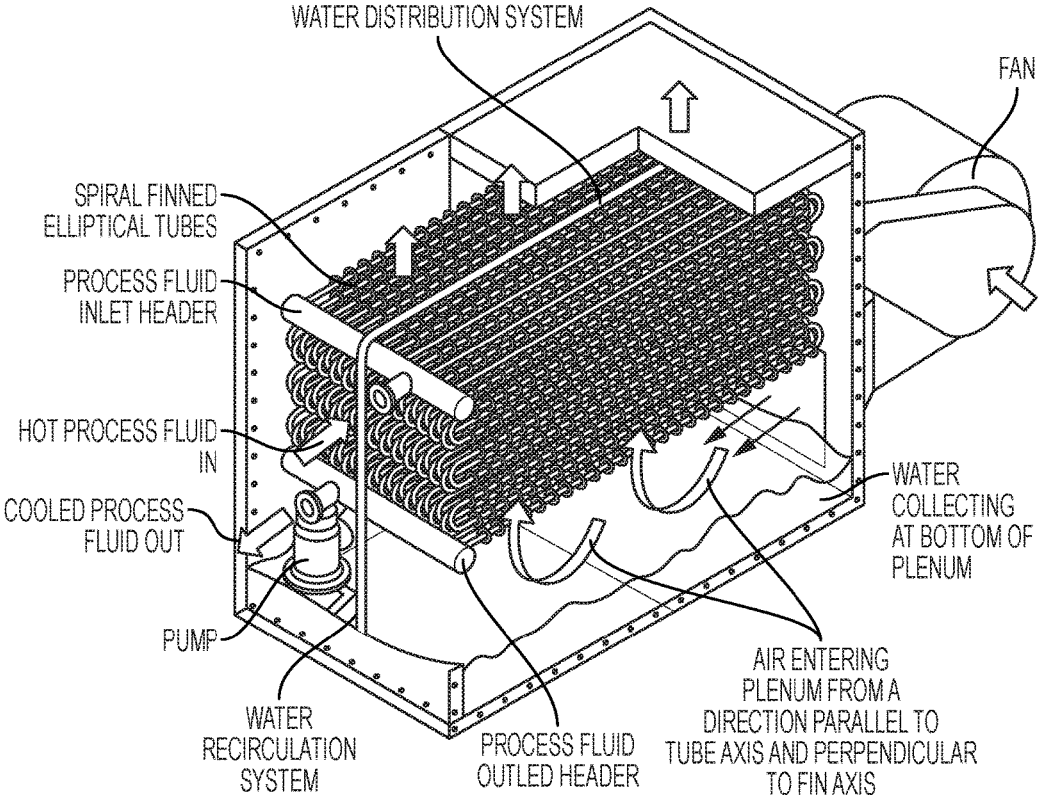
FIG. 5 is a cutaway view of a prior art induced forced draft single cell unit with axial fans on one side.

Referring to FIG. 5, a forced draft evaporative cooler of the invention has, from the top down, a water distribution system (not shown), followed by the tube coil, followed by the plenum. The tube coil is made of an array of serpentine elliptical tubes with spiral fins. Each length of tube is connected at its ends to an adjacent higher and/or lower tube length by a tube bend. Process fluid to be cooled enters the tubes via an inlet header and exits the tubes via an outlet header. Beneath the tube coil is the plenum, where air enters the unit and cools the water that flows over the coils, delivered via the water distribution system. The water collects at the bottom of the plenum and is recirculated to the top via water recirculation system, not shown. Axial or centrifugal fan is situated on a side of the plenum beneath the tube ends in order to force air into the plenum in a direction that is parallel to the longitudinal axis of the tube lengths. As with the induced draft evaporative coolers of the invention, forced draft evaporative coolers of the invention, in which air is forced into the plenum in a direction that is parallel to the longitudinal axis of spiral finned elliptical tube lengths increases the capacity of the device by 25% as compared to forcing the air into the plenum in a direction that is perpendicular to the longitudinal axis of the tube lengths (FIG. 4).

Figure 6:
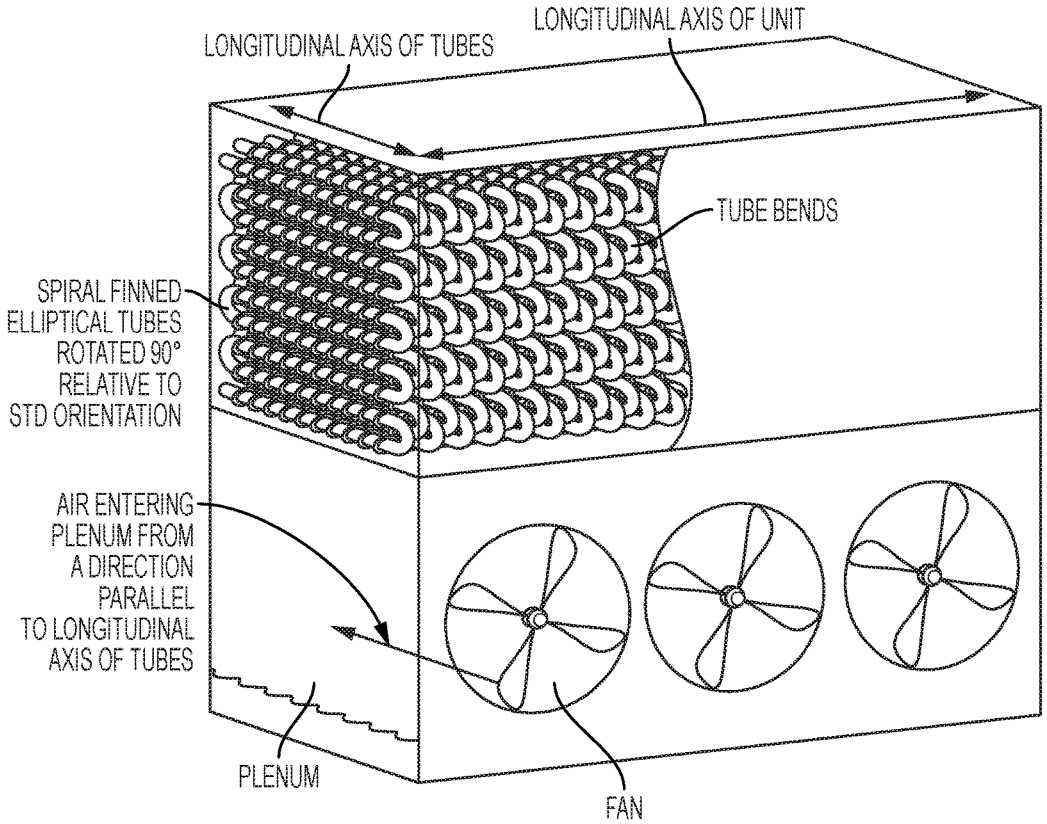
FIG. 6 is cutaway view of a forced draft unit with axial fans all on one side according to an embodiment of the invention.

According to another embodiment of the invention, shown in FIG. 6, the orientation of the tube coil in a forced draft unit may be rotated 90 degrees relative to the orientation in a prior art forced draft evaporative cooler with a spiral finned elliptical tube coil (FIG. 4) so that the tube ends are aligned across the longitudinal axis of the unit, above the location of the axial/centrifugal fans. According to this arrangement, the fans force the air into the plenum in a direction that is parallel to the longitudinal axis of the tubes, again with the highly unexpected result of increasing the capacity of the device by 25%.

Figure 7:
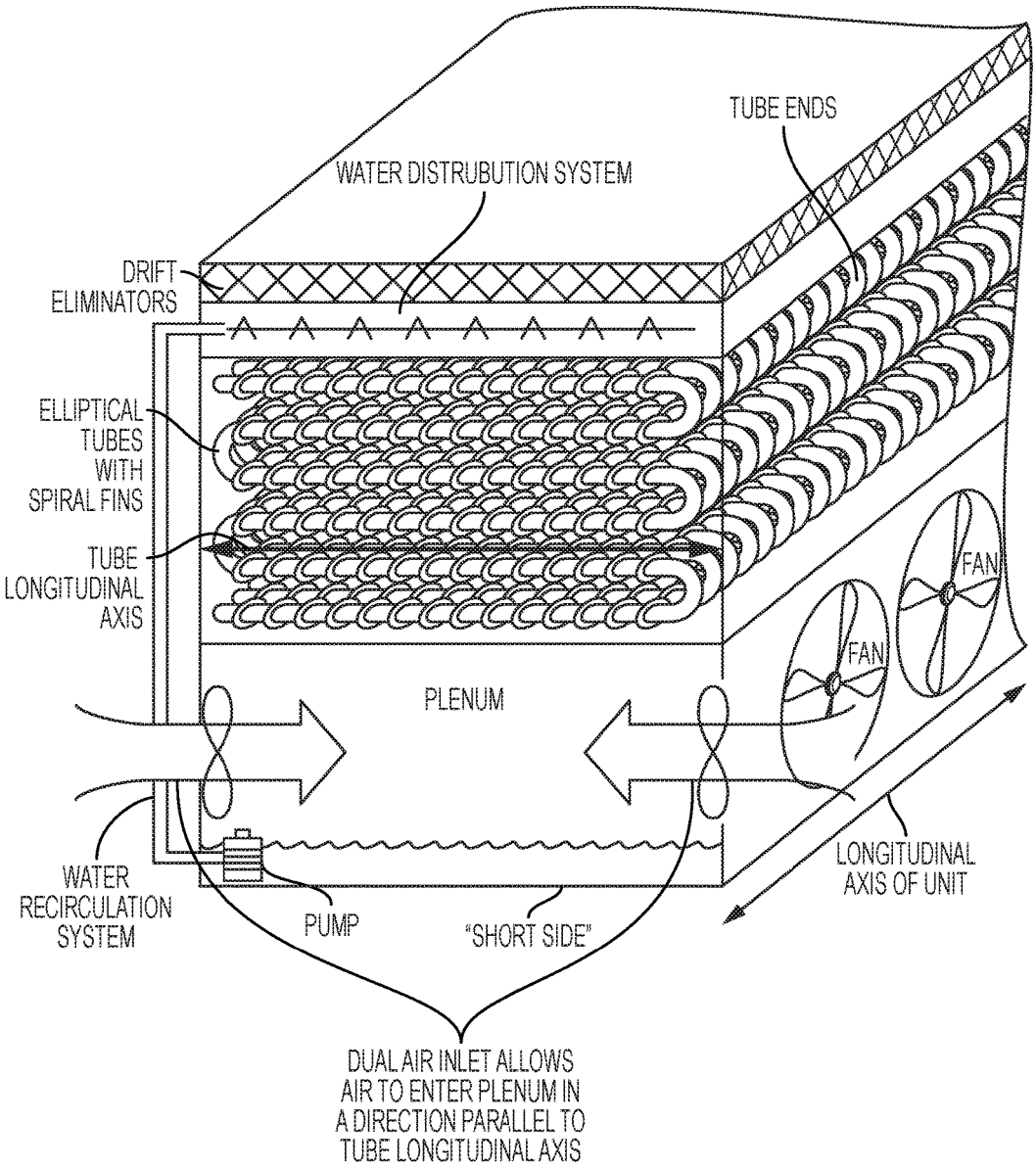
FIG. 7 is a cutaway view of a forced draft unit with axial fans all on one side according to another embodiment of the invention.

Referring to FIG. 7, according to a further embodiment of the invention, a second set of fans may be placed on a side of the plenum opposite a first set of fans in a forced air evaporative cooler with spiral finned elliptical tubes in which the tube coil is rotated 90degrees relative to the orientation of the tube coil in a prior art forced draft evaporative cooler. According to this embodiment, the longitudinal axes of the tubes are oriented perpendicular to the longitudinal axis of the unit, and one or more fans are situated under each set of tube ends, forcing air into the plenum in a direction that is parallel to the longitudinal axes of the tubes, unexpectedly increasing the capacity of the unit by 25%.

The invention claimed is:

1. An evaporative heat exchanger for cooling or condensing a process fluid, consisting essentially of:

an indirect evaporative heat exchange section;

a direct heat exchange section situated beneath the indirect evaporative heat exchange section;

a water distribution system located above the indirect evaporative heat exchange section and configured to spray water over the indirect evaporative heat exchange section;

the indirect evaporative heat exchange section comprising a process fluid inlet header and a process fluid outlet header, and an array of serpentine tubes connecting said inlet header and said outlet header, said serpentine tubes having an elliptical cross-section with spiral fins; said serpentine tubes further having lengths extending along a longitudinal axis, said lengths connected to adjacent lengths of a same serpentine tube by tube bends;

said direct section comprising a plenum where water distributed by said water distribution system and having received heat from said indirect evaporative heat exchange section is cooled by direct contact with air moving through said plenum;

a water recirculation system, including pump and pipes, configured to take water collecting in a basin at the bottom of said plenum and deliver it to said water distribution system;

an air mover configured to move ambient air into said plenum and up through said indirect evaporative heat exchange section;

wherein said evaporative heat exchanger is configured so that air is moved by said air mover into said plenum in a direction that is parallel to said longitudinal axis of said tube lengths and perpendicular to longitudinal axes of said spiral fins.

2. The evaporative heat exchanger according to claim 1, wherein substantially all air flow driven by said air mover into said indirect evaporative heat exchange section flows first through said plenum.

3. The evaporative heat exchanger according to claim 1, wherein said air mover is a fan, and said evaporative heat exchanger is an induced draft device and said fan is located above said water distribution system, and is configured to draw air from outside of said device into said plenum and up through said indirect evaporative heat exchange section.

4. The evaporative heat exchanger according to claim 3, wherein sides of said plenum parallel to said tube lengths are sealed to prevent substantial entry of air.

5. The evaporative heat exchanger according to claim 1, wherein is said air mover is a fan, and said evaporative heat exchanger is a forced draft device, and said fan is located at a side of said plenum that is beneath said tube bends.

6. The evaporative heat exchanger according to claim 5, wherein said longitudinal axis of said tube lengths is perpendicular to a longitudinal axis of said evaporative heat exchanger.

7. The evaporative heat exchanger according to claim 5, wherein said fan is configured to draw air from outside of said device and force it into said plenum in a direction that is parallel to said longitudinal axis of said tube lengths and perpendicular to longitudinal axes of said spiral fins.

8. The evaporative heat exchanger according to claim 7, wherein substantially all air flow entering said indirect evaporative heat exchange section is delivered by said fan.

9. The evaporative heat exchanger according to claim 8, wherein substantially no air enters said plenum except via said fan.

10. The evaporative heat exchanger according to claim 1, wherein said air mover is a first fan and a second fan, said first fan located at a side of said plenum that is beneath a set of tube bends at a first end of said tube lengths, said second fan located at a side of said plenum that is beneath a set of tube bends at a second end of said tube lengths.

11. The evaporative heat exchanger according to claim 10, wherein said fans are configured to draw air from outside of said device and force it into said plenum in a direction that is parallel to said longitudinal axis of said tube lengths and perpendicular to longitudinal axes of said spiral fins.

* * * * *